US006234854B1

(12) United States Patent
Rydzewski

(10) Patent No.: US 6,234,854 B1
(45) Date of Patent: May 22, 2001

(54) MARINE DRIVE ASSEMBLY

(76) Inventor: Eric J. Rydzewski, 2033 Middle Sound Loop Rd., Wilmington, NC (US) 28411

( * ) Notice: Subject to any disclaimer, the term of this patent is extended or adjusted under 35 U.S.C. 154(b) by 0 days.

(21) Appl. No.: 09/434,754

(22) Filed: Nov. 5, 1999

Related U.S. Application Data

(60) Provisional application No. 60/108,048, filed on Nov. 12, 1998.

(51) Int. Cl.[7] ..... B63H 5/125

(52) U.S. Cl. ..... 440/57; 440/53; 440/63; 440/78

(58) Field of Search ..... 440/53, 57, 61, 440/63, 66, 76, 78, 112

(56) References Cited

U.S. PATENT DOCUMENTS

| | | | | |
|---|---|---|---|---|
| 2,856,883 | * | 10/1958 | Baker | 115/41 |
| 3,933,116 | * | 1/1976 | Adams et al. | 115/35 |
| 4,544,362 | * | 10/1985 | Arneson | 440/61 |
| 4,597,742 | * | 7/1986 | Finkl | 440/61 |
| 4,645,463 | * | 2/1987 | Arneson | 440/57 |
| 4,790,782 | * | 12/1988 | McCormick | 440/61 |
| 4,976,638 | * | 12/1990 | Grinde | 440/57 |
| 5,246,392 | * | 9/1993 | Johnston | 440/42 |
| 5,290,182 | * | 3/1994 | Mondelop | 440/57 |
| 5,549,493 | * | 8/1996 | Bezzi | 440/61 |
| 5,667,415 | * | 9/1997 | Baker | 115/41 |

* cited by examiner

*Primary Examiner*—S. Joseph Morano
*Assistant Examiner*—Ajay Vasudeva
(74) *Attorney, Agent, or Firm*—Rhodes & Mason, PLLC

(57) ABSTRACT

A boat drive mechanism is constructed of an engine mounted in the boat; a propeller; a drive shaft having a front end connected to the engine and a rear end extending through the exterior of the transom; a propeller shaft having a rear end connected to the propeller and a front end, with the propeller shaft being moveable between a lowered position and a raised position; and a universal joint connecting the drive shaft rear end to the propeller shaft front end and spaced from the rear of the transom, the universal joint being the sole thrust connection between the drive shaft and the propeller shaft. A propeller tube surrounds at least a part of the propeller shaft. The propeller tube and shaft are raised and lowered by a first hydraulic cylinder pivotally connected to the propeller tube and the transom above the drive shaft. The propeller tube and shaft are moved laterally to steer the boat with a second hydraulic cylinder in operative communication with the propeller tube and shaft through the first hydraulic cylinder.

21 Claims, 4 Drawing Sheets

MARINE DRIVE ASSEMBLY

U.S. application Ser. No. 60/108,048 filed Nov. 12, 1998.

BACKGROUND OF THE INVENTION (1) Field of the Invention

The present invention relates generally to improved drive mechanisms for boats, especially for boats that are to be operated in shallow water, and boats incorporating such mechanisms.

(2) Description of the Prior Art

The prior art describes numerous types of drive mechanisms for boats, with the characteristics of any particular drive mechanism being determined, in part, by such factors as the boat size, and the environment in which the boat is to be operated. Drive mechanisms suitable for one boat size and/or environment may be unsuitable for another boat size and/or environment.

For example, small boats are often used in shallow water for various purposes, including hunting, fishing, oyster gathering, and other kinds of sporting and work activities. The drive mechanisms for such boats must be designed to be operable in this shallow water, and must also be resistant to damage for obstacles and debris often encountered in shallow water.

Some boats of this type, referred to herein as shallow draft boats, have been driven by above-water aircraft-type propellers or underwater jet drives. However, due to considerations of cost, ease of operation, and ease of repair, most shallow draft boats are propelled by an underwater or water-level propeller that is rotated through a drive shaft connected to an engine or motor.

The engine, drive shaft and propeller drive mechanisms can be configured in one of three ways. First, the engine can be mounted inside the boat with the drive shaft extending through the bottom of the boat to the propeller. This design adds to the draft of the boat, limiting its ability to operate in very shallow water, and prevents lifting of the propeller from the water if an obstacle is encountered.

Second, the mechanism can be mounted so that the drive shaft extends over the boat transom. In this configuration, the entire mechanism is usually designed to tilt or pivot, requiring movement of the engine to steer the boat. This mechanism does have the advantage that it can be readily removed from the boat for trailering, and to prevent fouling of the propeller by marine flora or fauna. A typical design of this type is illustrated in U.S. Pat. No. 4,676,756 to Rodrigue et al.

In a third design, the engine is mounted in the boat interior, and the drive shaft extends from the engine through the boat transom to the propeller. One section of the drive shaft may extend from the engine to the exterior of the boat transom, with a second drive shaft section extending from the first drive shaft section to the propeller. The distal end of the first section and the proximal end of the second section are connected by some flexible drive connection, so that the second drive section can be laterally pivoted to steer the boat. Typical examples of this type of mechanism are illustrated in U.S. Pat. No. 4,726,796 to Rivette, Jr., et al, and U.S. Pat. No. 2,996,035 to Torrey.

Drive mechanisms of this third type have the advantage of permitting the use of a larger engine, since movement of the engine during steering is not required. Thrust characteristics are also improved due to the alignment of the drive shaft. This mechanism can also be designed to lift when obstacles are encountered, preventing damage to the propeller and drive shaft. However, this mechanism, as described in the prior art, has significant disadvantages that limit its usefulness.

First, the drive shaft and attached propeller project a significant distance from the rear of the boat, rendering the boat difficult, and often hazardous, to launch, store and trailer. Prior art mechanisms, while permitting the mechanism to be raised slightly, do not allow the mechanism to be moved to a substantially vertical orientation that would avoid this problem.

Also, many prior art mechanisms are designed essentially for low-speed, non-planing uses. As a result, the user must travel at low speeds to reach the shallow water location, even when traveling through deep water. Steering mechanisms for prior art mechanisms of this type also tend to change the depth of the propeller in the water, altering the steering characteristics of the boat when the boat is being turned.

Modifications to prior art drive and steering mechanisms of this type to overcome these prior art deficiencies would significantly improve the performance of these mechanisms and boats incorporating the mechanisms, and their resultant commercial acceptance.

SUMMARY OF THE INVENTION

The present invention relates to a boat drive mechanism that overcomes the above disadvantages of prior art shallow water boat drives and to boats incorporating these improved drives.

While the present drive mechanism is designed primarily for use with a small, shallow draft boat, the drive mechanism will also find utility in larger boats. The boat may have a hull of various configurations, although the mechanism will normally be used with a boat having a flat-bottom hull. The boat may be formed of wood, aluminum, fiberglass, other materials commonly used to manufacture small boats, or combinations thereof. The boat will include a rear transom, preferably transverse to the longitudinal axis of the boat, through which the drive shaft of the drive mechanism extends.

In its broad aspects, the drive mechanism of the present invention is comprised of an engine, a rearwardly extending drive shaft having a forward end attached to the engine, a prop or propeller, a forward extending propeller shaft having a rear end attached to the propeller, a universal joint connecting the rear end of the drive shaft directly to the front end of the propeller shaft, a steering mechanism in operative communication with the propeller shaft for moving the shaft in a generally horizontal direction, and a lifting mechanism in operative communication with the propeller shaft for moving the propeller shaft in a vertical direction between a lowered position, and a raised, generally vertical position.

The drive mechanism will normally include other components including a stern tube or block that extends through the boat transom with the drive shaft extending through the stem tube to prevent leakage, a propeller tube surrounding the propeller shaft to protect the propeller shaft, upper and lower skegs extending from adjacent the rear end of the propeller tube to protect the propeller tube and propeller from encountered objects, and an anti-ventilation plate to minimize air entrainment from the surface down along the top of the propeller tube into the propeller.

The engine is an internal combustion engine containing modifications of known types to adapt the engine for marine use. As used herein, the term engine will be understood to include not only the internal combustion engine, but also its transmission and other operable components. The engine may be mounted in the lower part of the boat within a wide range of distances forward of the transom to suit the vessel layout and weight balance needs. Using a drop angle and/or drop center type marine transmission or a marine transmission modified to incorporate the characteristics of the aft end of the drive shaft and tube, the engine may be placed very near the transom.

The engine is connected to the propeller through a drive train comprised of a drive shaft having a front end connected to the engine, and a rear end; a propeller shaft having a rear end attached to the propeller, and a front end; and a universal joint connecting the rear end of the drive shaft to the front end of the propeller shaft. Unlike earlier drive trains in this type of drive mechanism, this universal joint serves as the only thrust connection between the drive shaft and propeller shaft. The drive train may also contain additional elements, e.g., a splined slip joint or an additional universal joint inside the boat.

This universal joint connecting the drive and propeller shafts may be of a conventional design, with a first rearwardly extending u-shaped yoke attached to the drive shaft, and a second forward extending u-shaped yoke attached to the propeller shaft. The two yokes are rotatably attached adjacent their outer ends to an X-shaped cross-piece, so that the propeller shaft can be oriented at various angles relative to the drive shaft. Also, unlike prior art mechanisms, the present universal joint is not enclosed in a housing that obstructs angular movement of the propeller shaft relative to the drive shaft. Instead, the four bearings of the universal joint are individually sealed from the elements. If the external portion of the drive requires service, it can be disconnected, removed from and reinstalled on the boat using hand tools, without removing the boat from the water.

Normally, the drive shaft will be positioned at an angle of from about +10° to about −10° relative to the bottom of the boat. When the boat is in operation at planing attitude, the propeller shaft will extend into the water at an angle of about 5–15° and the propeller shaft will be axially aligned to the drive shaft to within about 10°.

Vertical positioning of the propeller shaft is preferably effected with a telescoping controller that has a lower end pivotally attached to the propeller tube near the front end of the propeller tube and a short distance to the rear of the universal joint, and an upper end pivotally attached to the upper end of the transom above the drive train outlet, i.e., the opening in the transom through which the drive shaft projects.

The telescoping controller has a lowered or extended position to orient the propeller shaft to its lowest position, and a raised or retracted position to orient the propeller shaft to a fully raised position. The controller is adapted to extend to any position between its fully retracted position and its fully raised position.

Preferably, the telescoping controller is a fluid cylinder, e.g., a hydraulic or air cylinder, comprised of a cylinder housing and a piston rod that extends from the housing. A piston is carried by the rod within the housing and is moveable axially within the housing when a fluid is pumped into the housing on one side or the other of the piston. As a result, the piston rod is extended or retracted. In the preferred embodiment of the invention, the piston rod extends axially through the cylinder housing, so that a first end of the rod extends from one side of the housing and a second end of the rod extends from the other side of the housing. Thus, when the rod is moved within the housing one end is retracted as the other end is extended.

When the telescoping controller is in its fully lowered position, the propeller shaft extends into the water at an angle of from about 10° to about 20° below a line parallel to the bottom of the boat. When the telescoping controller is in its fully raised position, the propeller shaft projects upwardly at an angle of from about 5°0 to about 25° from vertical. Horizontal positioning of the propeller shaft is preferably also effected with a telescoping steering controller in operable communication with the propeller shaft. The term "operable communication" as used herein, means that the steering controller is connected directly or indirectly to the propeller shaft, whereby extension or retraction of the steering controller results in a corresponding movement by the propeller shaft. This telescoping controller has a fully extended and fully retracted position to orient the propeller shaft to at an angle to the longitudinal axis of the boat in order to steer the boat, and can be positioned at any point between its fully retracted and fully extended positions.

In a preferred embodiment, the telescoping steering controller is a hydraulic cylinder comprised of a housing with a longitudinal axis, and a piston rod carrying a piston that is moveable within the housing along the housing axis when a fluid is pumped into the housing on one side of the piston. Preferably, the piston rod extends through the housing so that a first end projects from one end of the housing, while a second end projects from the opposite end of the housing. Thus, movement of the piston to extend one rod end results in a corresponding retraction of the other rod end.

In a preferred embodiment of the invention, the lifting and steering controllers are hydraulic cylinders, each comprised of a housing with a longitudinal axis and a piston rod that extends through the housing along its longitudinal axis, so that a first end of the rod extends from one end of the housing and a second end of the rod extends from the opposite end of the housing. The steering cylinder is operatively connected through the lifting cylinder to the propeller shaft, so that axial movement of the rod within the housing of the steering cylinder causes a horizontal movement of the propeller shaft.

For example, the steering cylinder can be mounted in a substantially horizontal alignment on the boat transom, with the first or inner end of the steering piston rod being near the center of the boat transom and the second or outer end of the steering piston rod being toward the outer edge of the boat transom. The lifting cylinder is mounted in a generally vertical orientation, with the housing being pivotally connected to the boat transom and a first or lower end of the lift rod being pivotally connected to a propeller tube surrounding the propeller shaft at a distance behind a universal joint connecting the propeller shaft to the boat drive shaft.

The second or upper end of the lift rod is in communication with the inner end of the steering cylinder rod, so that longitudinal movement of the steering rod urges the lifting rod to rotate. The lower end of the rod is operatively connected to the propeller shaft so that the rod can only pivot in a plane along the longitudinal axis of the propeller shaft. As a result, propeller shaft is urged in a horizontal direction when the rod is rotated. In order for the propeller shaft to move in a horizontal plane, the lifting cylinder housing is mounted to be pivotal longitudinally and transversely, so that the lifting rod can be pivoted about the cylinder mount. Other types of steering mechanisms can also be used. For example, a simple tiller arm can be used instead of the steering cylinder.

With the above-described vertical telescoping controller, the propeller shaft can be lowered to submerge the propeller while planing, or the propeller shaft can be raised up and used in the surface-piercing mode, if desired. The drive is normally arranged such that the universal joint is operating at a small, i.e., less than 10°, angle with the propeller just below the surface of the water while planing.

When in the planing mode, there is a tendency for air to migrate rearwardly along the drive mechanism to the propeller, significantly reducing the propeller thrust. The present invention incorporates two improvements to prevent air from reaching the propeller during planing. First, the propeller tube is faired on the top surface to present a "teardrop" shape to the water flow. That is, instead of using a propeller tube that has a cylindrical cross-section, the cross-section of the present tube is generally cylindrical on the bottom, but has triangular-shaped upper surface. Thus, the upper sides of the tube terminate at a peak above the tube, and extend tangentially along the edges of the tube. Thus, the water flows around the tube in a streamlined manner with less turbulence.

One or more anti-ventilation plates are also attached to the drive mechanism to prevent air entrainment from the surface down along the top of the propeller tube where a region of low pressure exists. The anti-ventilation plate is positioned to be at about water level and in a generally horizontal orientation when the boat is in a planing orientation. Testing showed that without the teardrop shape and without the anti-ventilation plate, air is conducted along the top of the propeller tube, becoming entrained in the propeller, severely affecting performance at moderate planing speeds and above.

Upon impact with a submerged object, the drive tilts, opening a relief valve in the tilt hydraulic system, clearing the obstruction without damage. The flow of oil through the relief valve acts as an effective damper, absorbing the energy of the rising drive, preventing it from impacting the boat. The vessel can make way in very shallow water by tilting the drive to just clear the bottom, even if the propeller is only partially submerged. Nets, lines, trash etc. can be cleared from the propeller by tilting it from the water and accessing it from inside the boat. Noise created by prop wash flow over rudder and transmitted from rudder to hull in an inboard vessel is absent in the present invention.

Accordingly, one aspect of the present invention is to provide a boat drive mechanism having a transom comprising an engine; a propeller; a drive shaft having a front end operatively connected to the engine and a rear end, the drive shaft being adapted to extend through said boat transom, whereby the drive shaft rear end is spaced from the transom; a propeller shaft having a rear end connected to the propeller and a front end, the propeller shaft being moveable between a lowered position and a raised position; a universal joint connecting the drive shaft rear end to the propeller shaft front end, the universal joint being the sole thrust connection between the drive shaft and the propeller shaft; a telescoping lift controller pivotally mountable on the transom and having a lower end in operative communication with the propeller shaft to move the propeller shaft between raised and lowered positions; and a steering controller in operative communication with said propeller shaft to move said propeller shaft laterally.

Another aspect of the present invention is to provide a boat having a transom and a drive mechanism to propel the boat comprising an engine mounted in the boat; a propeller; a drive shaft having a front end connected to the engine and a rear end, the drive shaft extending through the boat transom, whereby the drive shaft rear end is spaced from the exterior of the transom; a propeller shaft having a rear end connected to the propeller and a front end, the propeller shaft being moveable between a lowered position and a raised position; a universal joint connecting the drive shaft rear end to the propeller shaft front end, the universal joint being the sole thrust connection between the drive shaft and the propeller shaft; a propeller tube surrounding at least a part of the propeller shaft; a first hydraulic cylinder for moving the propeller shaft between a raised position and a lowered position including a first housing pivotally connected to the transom, a first piston rod having a lower end pivotally connected to the propeller tube and an upper end; a steering arm having a first end attached to the piston rod upper end and a second end; and a second hydraulic cylinder for laterally moving the propeller shaft including a second housing pivotally connected to the transom and a second piston rod having a first end pivotally attached to the steering arm first end, whereby movement of the second piston rod causes a lateral movement of the propeller shaft.

These and other aspects of the present invention will become apparent to those skilled in the art after a reading of the following description of the preferred embodiment.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
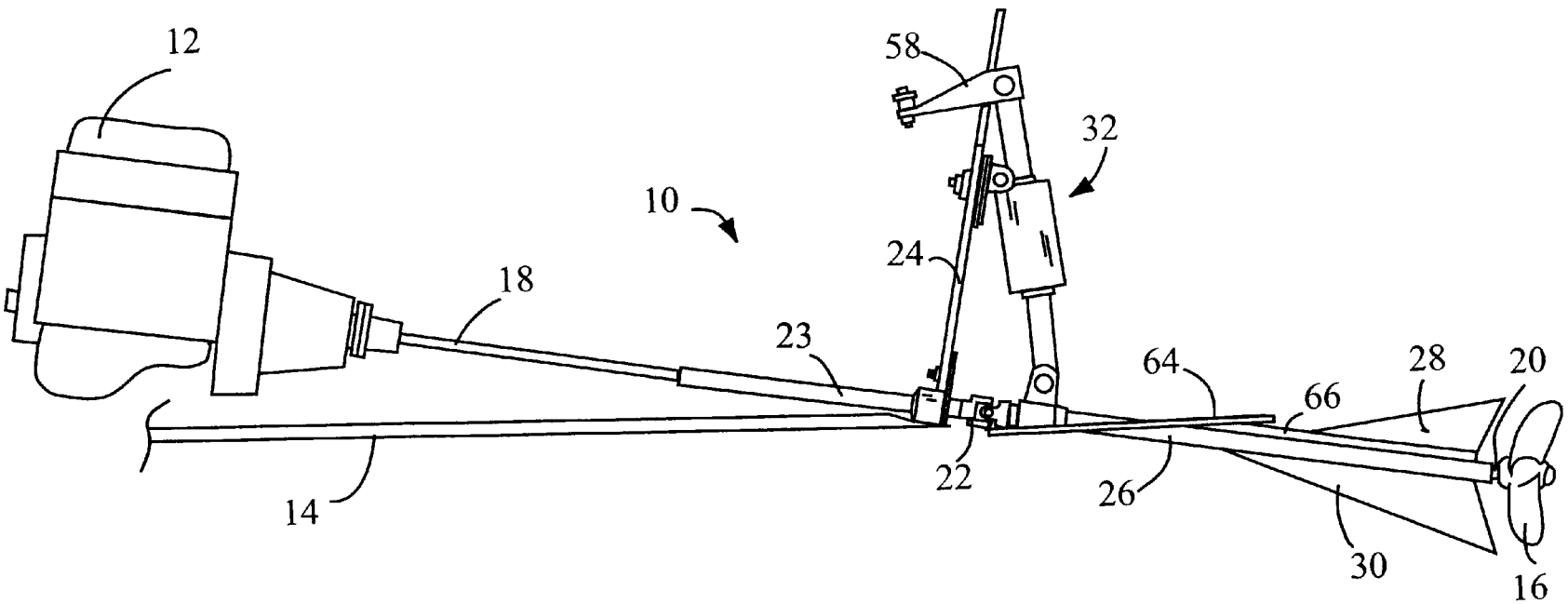
FIG. 1 is a sectional side view of the drive mechanism shown mounted in a boat.
Figure 2:
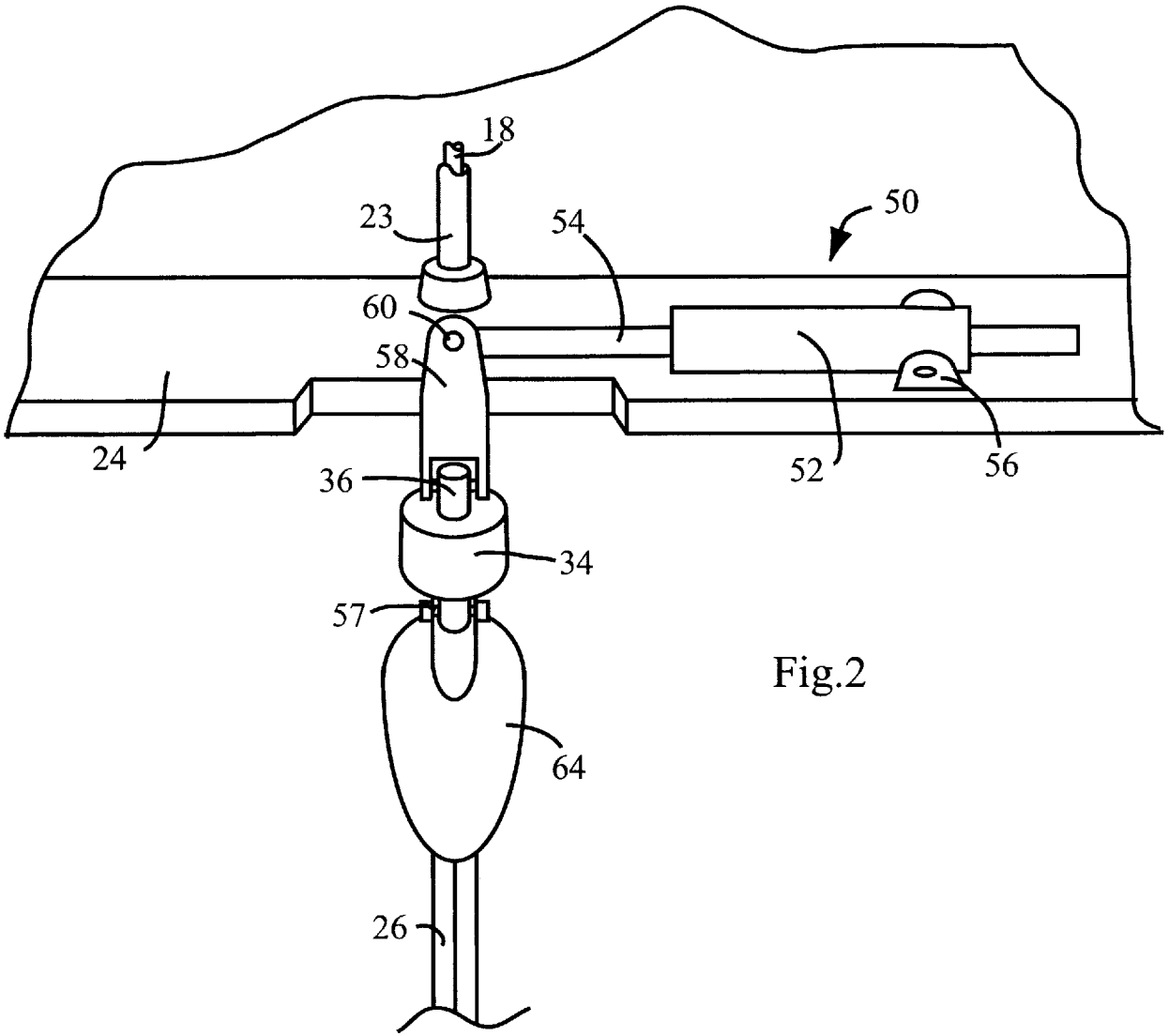
FIG. 2 is a top view of the rear portion of the drive mechanism in a lowered position, with the engine not shown, mounted in a boat (partially shown).
Figure 3:
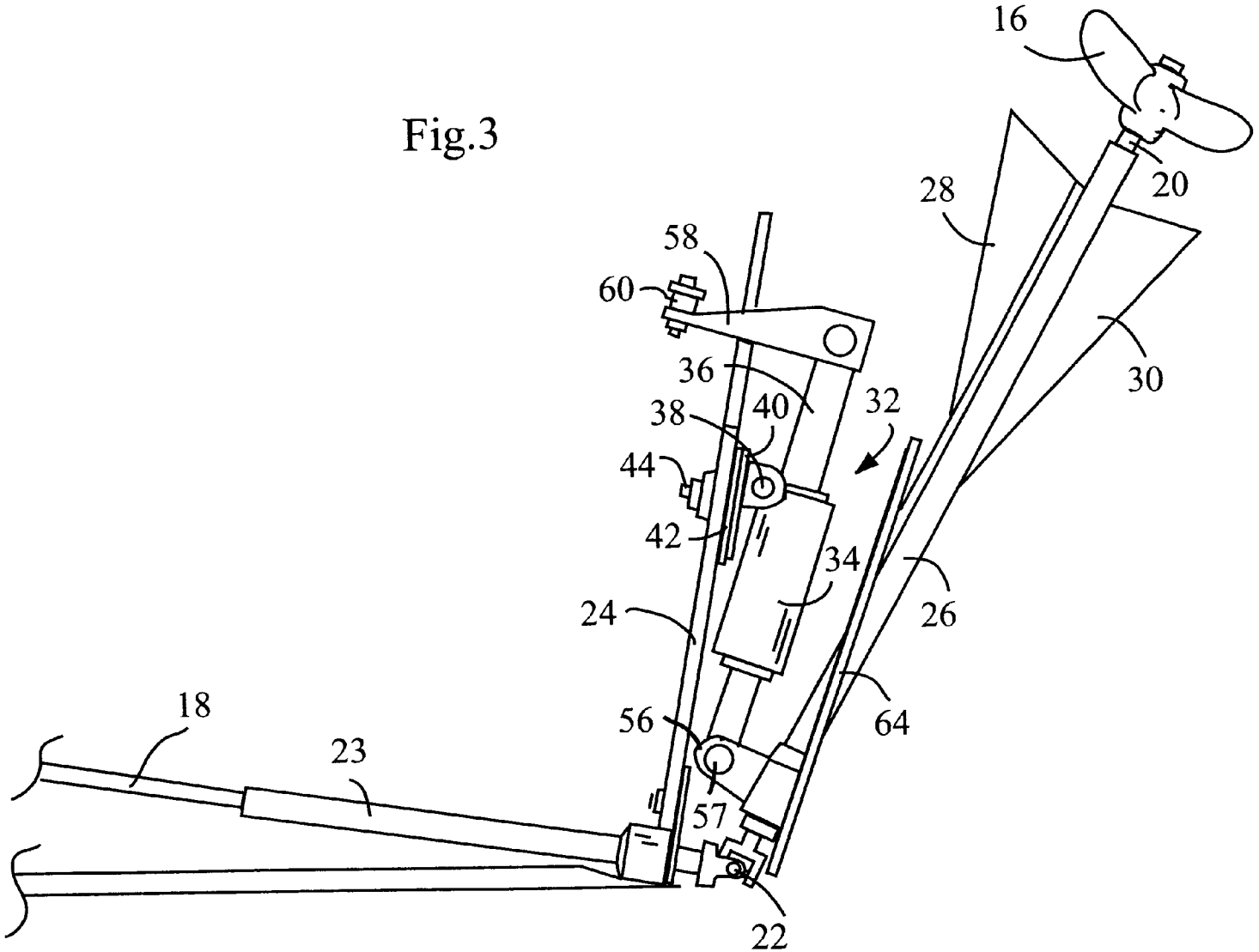
FIG. 3 is a side view of the rear portion of the drive mechanism in a raised position, with the engine not shown, mounted in a boat.

As best illustrated in FIGS. 1–3, a preferred embodiment of the drive mechanism, generally 10, of the invention is comprised of an engine 12 mounted in a shallow draft boat 14 (partially shown). Engine 12 communicates to a propeller 16 through a drive train comprised of a drive shaft 18 having a forward end operatively connected to engine 12, and a rear end; a propeller shaft 20 having a rear end connected to propeller 16, and a forward end; and a universal joint 22 acting as the sole connection between drive shaft 18 and propeller shaft 20.

Drive shaft 18 extends through the rear wall or transom 24 of boat 14. A stern tube 23 surrounds the part of shaft 18 extending through transom 24. Propeller shaft 20 is surrounded by a propeller tube 26. It will be understood to one skilled in the art that bearings will be positioned between shaft 18 and tube 23, and between shaft 20 and tube 26, to reduce friction. Upper and lower, vertically aligned skegs 28 and 30, respectively, extend from tube 26 adjacent its rear end to aid in steering and to protect propeller 16.

Propeller shaft 20, along with tube 26 and propeller 16, are raised and lowered to a desired position by hydraulic lifting cylinder, generally 32. Cylinder 32 is comprised of a housing 34 and piston rod 36, illustrated in FIGS. 2 and 3, and omitted for FIG. 1 for clarity of illustration. Cylinder housing 34 is pivotally connected above drive shaft 18 with pivot pin 38 to connector plate 40 which is rotatably attached on fixed plate 42 to transom 24 with rotation pin 44. Thus, the lower end of rod 36 can simultaneously move both longitudinally and laterally. It will be apparent to one skilled in the art that other attachment means can be used instead of plates 40 and 42 to achieve the same result. For example, a ball and socket connector can be used.

Rod 36 is attached at its lower end to propeller tube 26 with pivotal connector 56. Connector 56 includes a pivot pin 57 that extends through a bore in the lower end of rod 36 transverse to the longitudinal axis of propeller tube 26, so that rod 36 is moveable only in a plane parallel to the longitudinal axis of tube 26.

When in the retracted or raised position, the distance between the pivot pins 38 and 57 is less than the distance between drive shaft 18 and the pin 38. Universal joint 22 is also spaced from transom 24 at a distance greater than about one-half the width of cylinder 32. The components are dimensioned and connected to permit movement of cylinder 32 and propeller shaft 20 to positions substantially parallel to transom 24 for trailering, as best illustrated in FIG. 3.

Figure 4:
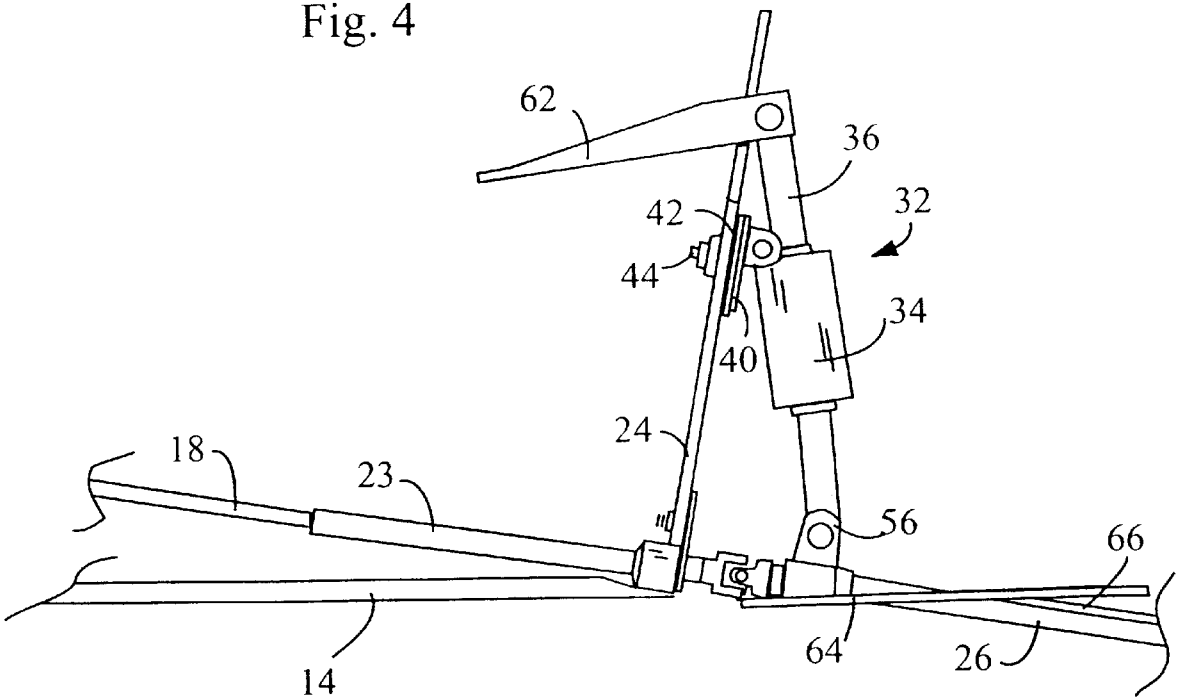
FIG. 4 is a partial side view of another embodiment of a part of a rear portion of the drive mechanism in a lowered position, with the engine and steering cylinder not shown, mounted in a boat. In this embodiment, a tiller is used instead of a hydraulic cylinder for steering.

A second hydraulic cylinder, generally 50, is used to steer the boat. Steering cylinder 50 is comprised of a housing 52 and piston rod 54. Cylinder housing 52 is attached to transom 24 with a pivotal connector 56 for pivotal and rotational movement. A connecting arm 58 has a first end attached to the upper end of rod 36, and a second end that is pivotally attached to an inner end of rod 54 at connector 60. Instead of cylinder 50, a manual tiller 62 can be connected to rod 36, as illustrated in FIG. 4.

Since the propeller is positioned close to the surface in drive mechanisms of the type described herein, prior art designs have experienced loss of thrust due to movement of air along the propeller shaft or tube and into the area of propeller rotation, especially during planing. This air movement is minimized in the present invention through the use of an anti-ventilation plate 64 and a unique propeller tube design.

Anti-ventilation plate 64 is mounted on propeller tube 26 to lie in a plane generally parallel to and slightly below the bottom of the boat when the boat is in a planing attitude. As a result, air above plate 64 is prevented from entering the low pressure region above tube 26, where the air would otherwise migrate along tube 26 to propeller 16.

Figure 5:
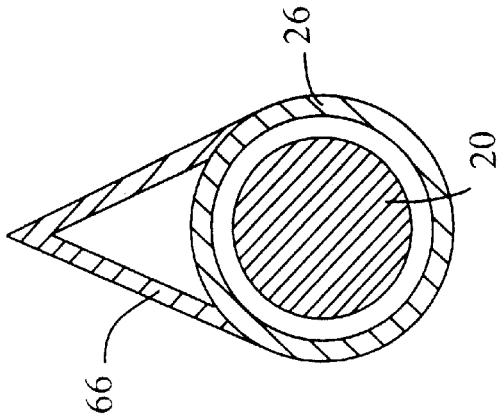
FIG. 5 is a cross-sectional view of the propeller shaft and surrounding tube, showing the triangular upper projection.

In prior art designs, a low-pressure zone is formed along the upper surface of the drive shaft or surrounding propeller tube. Air is captured in this zone and travels rearwardly to the propeller. This problem is avoided in the present invention with anti-ventilation plate 64, and by modifying the conventional cylindrical propeller tube by the addition of a triangular peak or fairing 66 along the top of the underwater portion of propeller tube 26 to produce a cross-sectional configuration like that shown in FIG. 5. As shown, propeller tube 26 is comprised of a semi-circular lower section and a triangular upper section with side walls that extend downwardly from an apex along the tangent of the lower semi-circular section. With this configuration, water flows around propeller tube 26 without air being captured on the upper side of tube 26. Fairing 66 extends along tube 26 from beneath anti-ventilation plate 64 to near propeller 16.

When used in shallow water, rod 36 in cylinder housing 34 is raised to pivot propeller shaft 20 so that propeller 16 is at a height sufficient to clear the bottom. When in deeper water at higher speeds, rod 36 can be extended to lower shaft 20, so that anti-ventilation plate 64 is in a plane nearly parallel to the bottom of boat 14. When boat 14 is to be removed from the water for trailering, or docked for an extended period, rod 36 is fully retracted to raise tube 26 to its fully raised position.

Steering is effected by extending and retracting rod 54 in cylinder housing 52. When rod 54 is moved along the longitudinal axis of cylinder housing 52, connecting arm 58 and attached rod 36 are rotated. Since the lower end of rod 36 is attached to propeller tube 26 so that rod 36 can only pivot in a plane along the longitudinal axis of tube 26, tube 26 is moved in a nearly horizontal direction in response to the action of steering cylinder 50. At the same time, maintenance of propeller tube 26, and propeller 16 in a horizontal plane, or at a generally constant level, can be achieved by raising or lowering rod 36 as propeller tube 26 is moved to one side or the other of the longitudinal axis of boat 14.

Certain modifications and improvements will occur to those skilled in the art upon a reading of the foregoing description. Such modifications and improvements have been deleted herein for the sake of conciseness and readability but are properly within the scope of the following claims.

What is claimed is:

1. A boat drive mechanism for a boat having a transom, comprising:

a) an engine;

b) a propeller;

c) a drive shaft having a front end operative connected to said engine and a rear end;

d) a propeller shaft having a rear end operatively connected to said propeller and a front end, said propeller shaft being moveable between a lowered position and a fully raised position and adaptable to be substantially parallel to the transom of the boat in the fully raised position; and e) a universal joint connecting said drive shaft rear end to said propeller shaft front end, said universal joint being the sole thrust connection between said drive shaft and said propeller shaft, said universal joint being free of any housing obstructing movement of said propeller shaft for said lowered position to said fully raised position.

2. The drive mechanism of claim 1, further including a telescoping controller adapted to move said propeller shaft between a lowered position and a raised position.

3. The drive mechanism of claim 1, further including a steering controller to move said propeller shaft laterally.

4. The drive mechanism of claim 1, further including a propeller tube surrounding a part of said propeller shaft.

5. A drive mechanism mountable on a boat having a transom and a bottom comprising:

a) an engine;

b) a propeller;

c) a drive shaft having a front end operatively connected to said engine and a rear end, said drive shaft being adapted to extend through said boat transom;

d) a propeller shaft having a rear end operatively connected to said propeller and having a front end, said propeller shaft being moveable between a lowered position and a raised position;

e) a universal joint connecting sad drive shaft rear end to said propeller shaft front end, said universal joint being the sole thrust connection between said drive shaft and said propeller shaft;

f) a telescoping lift controller operatively connected to said propeller shaft to move said propeller shaft between raised and lowered positions, said telescoping lift controller having an extended position and a retracted position, said propeller shaft being adapted for alignment substantially parallel to said transom when in said lift controller is in said retracted position; and g) a steering controller operatively connected to said propeller shaft to move said propeller shaft laterally.

6. The drive mechanism of claim 5, further including a propeller tube surrounding at least a part of said propeller shaft.

7. The drive mechanism of claim 6, wherein said propeller tube has a triangular-shaped upper surface.

8. The drive mechanism of claim 6, further including an anti-ventilation plate attached to said propeller tube, said anti-ventilation plate being positionable substantially parallel to the bottom of said boat when said boat is in a planing attitude.

9. The drive mechanism of claim 8, wherein the triangular-shaped upper surface of said propeller tube has a forward end beneath said anti-ventilation plate.

10. The drive mechanism of claim 5, wherein said steering controller is in operative communication with said propeller shaft through said lift controller.

11. The drive mechanism of claim 5, wherein said telescoping lift controller is a hydraulic cylinder including a housing pivotally attachable to said transom, and a piston rod moveable within said housing between raised and lowered positions, said piston rod having a lower end in operative communication with said propeller shaft.

12. The drive mechanism of claim 5, wherein said steering controller is a hydraulic cylinder including a housing pivotally attachable to said transom, and a piston rod moveable through said housing between extended and retracted positions, said piston rod having a first end operatively connected to said lift controller.

13. The drive mechanism of claim 5, wherein said lifting controller is a first hydraulic cylinder including a first housing pivotally connectable to said transom, and a first piston rod having a lower end pivotally connected to said propeller tube and an upper end; said drive mechanism further including a steering arm having a first end attached to said first piston rod upper end and having a second end; and said steering mechanism is a second hydraulic cylinder for laterally moving said propeller shaft including a second housing pivotally connectable to said transom and a second piston rod having a first end pivotally attached to said steering arm second end, whereby movement of said second piston rod causes a lateral movement of said propeller shaft.

14. The drive mechanism of claim 5, wherein said lift controller and said propeller shaft are substantially parallel to said transom when said propeller shaft is in the fully raised position.

15. A boat having a transom and a drive mechanism to propel said boat; said drive mechanism comprising:

a) an engine mounted in said boat;

b) a propeller;

c) a drive shaft having a front end connected to said engine and a rear end, said drive shaft extending through said boat transom;

d) a propeller shaft having a rear end connected to said propeller and a front end, said propeller shaft being moveable between a lowered position and a raised position;

e) a universal joint connecting said drive shaft rear end to said propeller shaft front end, said universal joint being the sole thrust connection between said drive shaft and said propeller shaft;

f) a propeller tube surrounding at least a part of said propeller shaft;

g) a first hydraulic cylinder for moving said propeller shaft between a raised position and a lowered position including a first housing pivotally connected to said transom, and a first piston rod having a lower end pivotally connected to said propeller tube and an upper end;

h) a steering arm having a first end attached to said first piston rod upper end and a second end; and i) a second hydraulic cylinder for laterally moving said propeller shaft including a second housing pivotally connected to said transom and a second piston rod having a first end pivotally attached to said steering arm second end, whereby movement of said second piston rod causes a lateral movement of said propeller shaft.

16. The boat of claim 15, wherein said propeller tube has a triangular-shaped upper surface, and a generally hemispherical lower surface.

17. The boat of claim 15, further including an anti-ventilation plate attached to said propeller tube, said plate being positionable in a plane substantially parallel to the bottom of said boat, when said boat is in a planing attitude.

18. The boat of claim 15, wherein said lift controller and said propeller shaft are substantially parallel to said transom when said propeller shaft is in the fully raised position.

19. A drive mechanism mountable on a boat having a transom comprising:

a) an engine;

b) a propeller;

c) a drive shaft having a front end operatively connected to said engine and a rear end, said drive shaft being adapted to extend through said boat transom;

d) a propeller shaft having a rear end operatively connected to said propeller and a front end, said propeller shaft being moveable between a lowered position and a fully raised position, and adaptable to be substantially parallel to the transom of the boat in the fully raised position;

e) a propeller tube surrounding at least a part of said propeller shaft, said propeller tube having a triangular-shaped upper surface; and f) a universal joint connecting said drive shaft rear end to said propeller shaft front end, said universal joint being the sole thrust connection between said drive shaft and said propeller shaft;

g) a telescoping lift controller operatively connected to said propeller shaft to move said propeller shaft between fully raised and lowered positions; and h) a steering controller operatively connected to said propeller shaft to move said propeller shaft laterally.

20. The boat drive mechanism of claim 19, further including an anti-ventilation plate attached to said propeller tube.

21. The boat drive mechanism of claim 20, wherein said triangular-shaped upper surface has a forward end beneath said anti-ventilation plate.

* * * * *